US009566806B2

(12) United States Patent
Taguchi et al.

(10) Patent No.: US 9,566,806 B2
(45) Date of Patent: Feb. 14, 2017

(54) PRINTING APPARATUS AND METHOD IN WHICH ROTATION SPEED OF CONVEYANCE AND REVERSING ROLLERS IS CONTROLLED BASED ON AMOUNT OF DISCHARGED INK ON FIRST SURFACE OF PRINTING SHEET

(71) Applicant: CANON KABUSHIKI KAISHA, Tokyo (JP)

(72) Inventors: Motoyuki Taguchi, Komae (JP); Noriyuki Sugiyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/816,126

(22) Filed: Aug. 3, 2015

(65) Prior Publication Data

US 2016/0052309 A1 Feb. 25, 2016

(30) Foreign Application Priority Data

Aug. 25, 2014 (JP) ..... 2014-170894

(51) Int. Cl.
*B41J 2/01* (2006.01)
*B41J 13/00* (2006.01)
*B41J 3/60* (2006.01)

(52) U.S. Cl.
CPC ..... *B41J 13/0009* (2013.01); *B41J 3/60* (2013.01); *B41J 13/0045* (2013.01)

(58) Field of Classification Search
CPC ..... B41J 11/0085; B41J 11/42; B41J 11/51; B41J 13/0009; B41J 13/0027
USPC ..... 347/5, 16, 102, 104; 271/3.15, 153, 227, 271/243, 270
See application file for complete search history.

(56) References Cited

U.S. PATENT DOCUMENTS

| | | | | |
|---|---|---|---|---|
| 6,616,361 | B2 | 9/2003 | Sugiyama | |
| 6,824,234 | B2 | 11/2004 | Sugiyama et al. | |
| 7,360,857 | B2 * | 4/2008 | Koshikawa | B41J 3/60 347/102 |
| 8,094,180 | B2 | 1/2012 | Onuma et al. | |
| 8,794,741 | B2 * | 8/2014 | Danzuka | B41J 2/16535 347/33 |
| 2002/0024574 | A1 | 2/2002 | Uchida | |

(Continued)

FOREIGN PATENT DOCUMENTS

| | | |
|---|---|---|
| JP | 2003-048311 | 2/2003 |
| JP | 2005-280213 | 10/2005 |
| JP | 2011-230493 | 11/2011 |

*Primary Examiner* — Erica Lin
(74) *Attorney, Agent, or Firm* — Fitzpatrick, Cella, Harper & Scinto

(57) ABSTRACT

A printing apparatus includes: a printhead configured to print an image by discharging ink to a first surface as a front surface of a printing sheet and a second surface as a back surface of the printing sheet; a conveyance roller configured to perform a first conveyance operation of conveying a printing sheet to a position facing the printhead, and a second conveyance operation of conveying the printing sheet in a direction opposite to a conveyance direction in the first conveyance operation after the image is printed on the first surface of the printing sheet; a reversing roller configured to reverse the printing sheet conveyed by the second conveyance operation; and a control unit configured to control a driving speed of the reversing roller based on an ink discharge amount on the first surface of the printing sheet.

29 Claims, 16 Drawing Sheets

(56) References Cited

U.S. PATENT DOCUMENTS

| | | | | |
|---|---|---|---|---|
| 2007/0030299 | A1 | 2/2007 | Izuchi | |
| 2007/0216725 | A1 * | 9/2007 | Hosono | B41J 2/21 347/47 |
| 2011/0267396 | A1 | 11/2011 | Yamamoto et al. | |

* cited by examiner

FIG. 9

TB1

| PRINTING SHEET Duty | | | |
|---|---|---|---|
| | FIRST THRESHOLD ≤ | SECOND THRESHOLD ≤ | THIRD THRESHOLD ≤ |
| < FIRST THRESHOLD | < SECOND THRESHOLD | < THIRD THRESHOLD | |
| DV1 | DV2 | DV3 | DV4 |

TB2 inch/s

| SELECTION TABLE LIST | DV1 | DV2 | DV3 | DV4 |
|---|---|---|---|---|
| CONVEYANCE ROLLER | 7.5 | 5.33 | 3.33 | 2 |
| REVERSING ROLLER | 8.06 | 5.73 | 3.58 | 2.15 |
| FEEDING ROLLER | 8.06 | 5.73 | 3.58 | 2.15 |

FIG. 12

TB3

| | AREA MAXIMUM Duty | | | |
|---|---|---|---|---|
| | | FIRST THRESHOLD ≤ | SECOND THRESHOLD ≤ | THIRD THRESHOLD ≤ |
| NUMBER OF THRESHOLD DETERMINATION FLAGS | < FIRST THRESHOLD | < SECOND THRESHOLD | < THIRD THRESHOLD | |
| 1 | DV1 | DV1 | DV2 | DV4 |
| 2 | DV1 | DV1 | DV2 | DV4 |
| 3 | DV1 | DV2 | DV3 | DV4 |
| 4 | DV1 | DV2 | DV3 | DV4 |
| • | DV1 | DV2 | DV3 | DV4 |
| • | DV1 | DV3 | DV4 | DV4 |
| • | DV1 | DV3 | DV4 | DV4 |
| n-3 | DV1 | DV3 | DV4 | DV4 |
| n-2 | DV1 | DV3 | DV4 | DV4 |
| n-1 | DV1 | DV4 | DV4 | DV4 |
| n ≥ | DV1 | DV4 | DV4 | DV4 |

FIG. 13B

A

LEADING EDGE OF PRINTING SHEET

| | | | | | | | | | |
|---|---|---|---|---|---|---|---|---|---|
| 2 | 2 | 2 | 1 | • | • | 1 | 2 | 2 | 2 |
| 2 | 2 | 2 | 1 | | | 1 | 2 | 2 | 2 |
| 2 | 2 | 2 | 1 | | | 1 | 2 | 2 | 2 |
| 1 | 1 | 1 | 1 | | | 1 | 1 | 1 | 1 |
| 1 | 1 | 1 | • | | | • | • | • | 1 |
| 1 | 1 | • | | | | | | • | • |
| 1 | • | WEIGHTING COEFFICIENT E2 | | | | | | | |
| • | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| | | | | | | | | | |
| • | • | | | | | | • | • | • |
| • | • | • | • | | | | • | • | • |
| 1 | 1 | 1 | 1 | • | • | • | 1 | 1 | 1 |
| 2 | 2 | 2 | 2 | • | • | • | 2 | 2 | 2 |
| 3 | 3 | 3 | 3 | • | • | • | 3 | 3 | 3 |
| 3 | 3 | 3 | 3 | • | • | • | 3 | 3 | 3 |
| 3 | 3 | 3 | 3 | • | • | • | 3 | 3 | 3 |

TRAILING EDGE OF PRINTING SHEET

REVERSING DIRECTION AT TIME OF REVERSING OPERATION

PT4

FIG. 14A

TB4a

| FOR D1, D4, D5 | AREA MAXIMUM Duty | | | |
|---|---|---|---|---|
| | | FIRST THRESHOLD ≤ | SECOND THRESHOLD ≤ | THIRD THRESHOLD ≤ |
| NUMBER OF THRESHOLD DETERMINATION FLAGS | < FIRST THRESHOLD | < SECOND THRESHOLD | < THIRD THRESHOLD | |
| 1 | DV1 | DV1 | DV1 | DV1 |
| 2 | DV1 | DV1 | DV1 | DV1 |
| 3 | DV1 | DV1 | DV1 | DV1 |
| 4 | DV1 | DV2 | DV2 | DV2 |
| ・ | DV1 | DV2 | DV2 | DV2 |
| ・ | DV1 | DV2 | DV3 | DV3 |
| ・ | DV1 | DV2 | DV3 | DV3 |
| n-3 | DV1 | DV2 | DV3 | DV3 |
| n-2 | DV1 | DV2 | DV3 | DV4 |
| n-1 | DV1 | DV2 | DV4 | DV4 |
| n ≥ | DV1 | DV2 | DV4 | DV4 |

FIG. 14B

TB4b

| FOR D2, D3 | AREA MAXIMUM Duty | | | |
|---|---|---|---|---|
| | | FIRST THRESHOLD ≤ | SECOND THRESHOLD ≤ | THIRD THRESHOLD ≤ |
| NUMBER OF THRESHOLD DETERMINATION FLAGS | < FIRST THRESHOLD | < SECOND THRESHOLD | < THIRD THRESHOLD | |
| 1 | DV1 | DV2 | DV3 | DV4 |
| 2 | DV1 | DV2 | DV3 | DV4 |
| 3 | DV1 | DV2 | DV3 | DV4 |
| 4 | DV1 | DV2 | DV3 | DV4 |
| • | DV1 | DV2 | DV3 | DV4 |
| • | DV1 | DV2 | DV3 | DV4 |
| • | DV1 | DV2 | DV3 | DV4 |
| n-3 | DV1 | DV2 | DV3 | DV4 |
| n-2 | DV1 | DV2 | DV3 | DV4 |
| n-1 | DV1 | DV2 | DV3 | DV4 |
| n ≥ | DV1 | DV2 | DV3 | DV4 |

PRINTING APPARATUS AND METHOD IN WHICH ROTATION SPEED OF CONVEYANCE AND REVERSING ROLLERS IS CONTROLLED BASED ON AMOUNT OF DISCHARGED INK ON FIRST SURFACE OF PRINTING SHEET

BACKGROUND OF THE INVENTION

Field of the Invention

The present invention relates to a printing apparatus for printing on a printing sheet, a control method for a printing apparatus, and a storage medium.

Description of the Related Art

Japanese Patent Laid-Open No. 2003-48311 discloses an arrangement in which a setting unit is provided to variably set, in accordance with image data to be printed on the first surface of a printing sheet, the time from when printing on the first surface ends until printing on the second surface starts.

In the arrangement disclosed in Japanese Patent Laid-Open No. 2003-48311, however, when the printing sheet passes through a portion having a high conveyance resistance while conveying the second surface to a printing region facing a printhead, the printing sheet may be folded at a portion where the printing sheet readily deflects due to ink at the time of printing on the first surface, thereby causing a conveyance failure.

The present invention has been made in consideration of the above problem, and provides a printing technique in which even if a printing sheet readily deflects due to printing on the first surface, it is possible to convey the reversed printing sheet to the printing region without causing a conveyance failure, and print on the second surface.

SUMMARY OF THE INVENTION

According to one aspect of the present invention, there is provided a printing apparatus comprising: a printhead configured to print an image by discharging ink to a first surface as a front surface of a printing sheet and a second surface as a back surface of the printing sheet; a conveyance roller configured to perform a first conveyance operation of conveying a printing sheet to a position facing the printhead, and a second conveyance operation of conveying the printing sheet in a direction opposite to a conveyance direction in the first conveyance operation after the image is printed on the first surface of the printing sheet; a reversing roller configured to reverse the printing sheet conveyed by the second conveyance operation; and a control unit configured to control a driving speed of the reversing roller based on an ink discharge amount on the first surface of the printing sheet.

According to another aspect of the present invention, there is provided a control method for a printing apparatus including a printhead configured to print an image by discharging ink to a first surface as a front surface of a printing sheet and a second surface as a back surface of the printing sheet, a conveyance roller configured to perform a first conveyance operation of conveying a printing sheet to a position facing the printhead, and a second conveyance operation of conveying the printing sheet in a direction opposite to a conveyance direction in the first conveyance operation after the image is printed on the first surface of the printing sheet, and a reversing roller configured to reverse the printing sheet conveyed by the second conveyance operation, the method comprising: a control step of controlling a driving speed of the reversing roller based on an ink discharge amount on the first surface of the printing sheet.

According to the present invention, even if a printing sheet readily deflects due to printing on the first surface, it is possible to convey the reversed printing sheet to a printing region without causing a conveyance failure, and print on the second surface.

Further features of the present invention will become apparent from the following description of exemplary embodiments (with reference to the attached drawings).

BRIEF DESCRIPTION OF THE DRAWINGS

FIG. 9 is a view for explaining reversing speed selection tables in the printing apparatus according to the embodiment;

FIG. 12 is a table for explaining a reversing speed selection table in the printing apparatus according to the embodiment;

FIGS. 13A and 13B are views exemplifying weighting coefficients set in respective partial regions obtained by dividing the first surface of the printing sheet; and FIGS. 14A and 14B are views for explaining reversing speed selection tables in the printing apparatus according to the embodiment.

DESCRIPTION OF THE EMBODIMENTS

Embodiments of the present invention will be exemplarily described in detail below with reference to the accompanying drawings. Note that components to be described in these embodiments are merely examples. The technical scope of the present invention is defined by the scope of the claims, and is not limited by the following embodiments.

First Embodiment

FIGS. 1 to 5 are sectional views for explaining a reversing operation in a printing apparatus according to the embodiment of the present invention. The schematic arrangement of the printing apparatus according to this embodiment will first be described with reference to ST1 of FIG. 1. The printing apparatus according to this embodiment can print on both the first surface of a printing sheet and the second surface (the surface difference from the first surface of the printing sheet) of the printing sheet.

Figure 1:
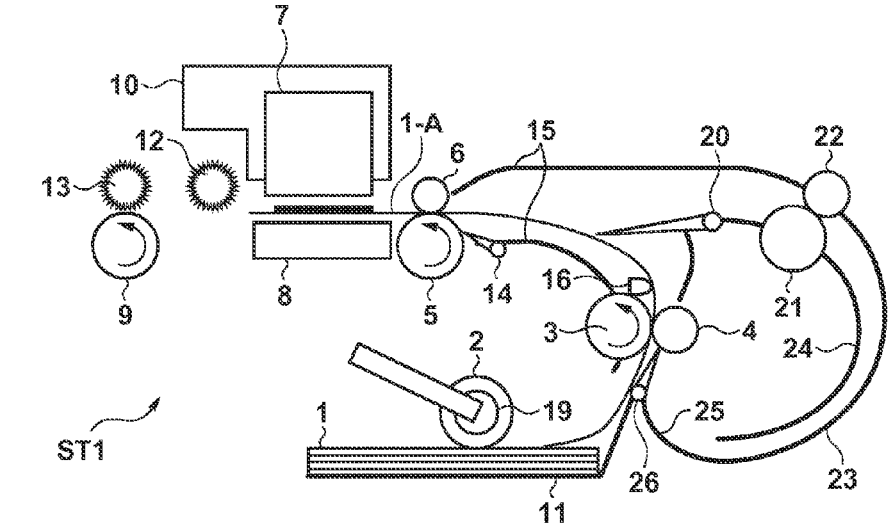
FIG. 1 is a view for explaining a printing sheet reversing operation in a printing apparatus according an embodiment.
Figure 1:
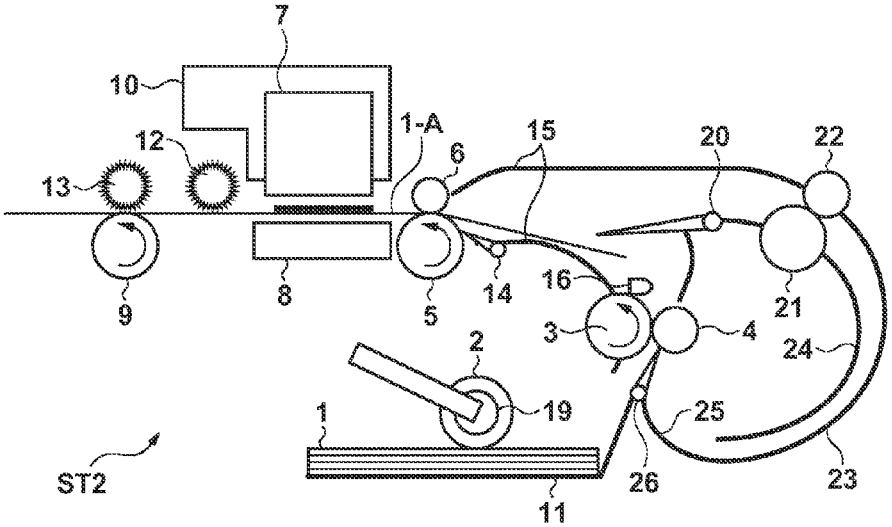

In ST1 of FIG. 1, reference numeral 1 denotes printing sheets. The plurality of printing sheets 1 are stacked on a feeding tray 11 (a stacking unit). A feeding roller 2 contacts the top printing sheet 1 stacked on the feeding tray 11 to pick it up. An intermediate roller 3 feeds the printing sheet 1 picked up by the feeding roller 2 toward the downstream side of a sheet conveyance direction. An intermediate pinch roller (intermediate driven roller) 4 is biased against the intermediate roller 3 to nip the printing sheet 1 with the intermediate roller 3, thereby feeding the printing sheet 1.

A conveyance roller 5 conveys the printing sheet 1 fed by the intermediate roller 3 and intermediate driven roller 4 to a position facing a printhead 7. The conveyance roller performs the first conveyance operation of conveying a printing sheet to the position facing the printhead, and the second conveyance operation of conveying the printing sheet in a direction opposite to the conveyance direction in the first conveyance operation after an image is printed on the first surface of the printing sheet. A pinch roller 6 is biased against the conveyance roller 5 to nip the printing sheet with the conveyance roller 5, thereby conveying the printing sheet.

The printhead 7 prints on the printing sheet 1 conveyed by the conveyance roller 5 and pinch roller 6. The printhead prints images on the first surface as the front surface of the printing sheet and the second surface as the back surface of the printing sheet by discharging ink. In this embodiment, an inkjet printhead which prints on the printing sheet 1 by discharging ink from the printhead will be exemplified. A platen 8 supports the back surface of the printing sheet 1 at the position facing the printhead 7. A carriage 10 incorporates the printhead 7 and moves in a direction intersecting the sheet conveyance direction. The printhead 7 is detachably mounted on the carriage 10 which moves in the direction intersecting the sheet conveyance direction. The moving direction of the carriage 10 is the direction (main-scanning direction) intersecting the printing sheet conveyance direction (sub-scanning direction).

A discharge roller 9 discharges the printing sheet printed by the printhead 7 to the outside of the apparatus. Spurs 12 and 13 rotate while they are in contact with the printing surface of the printing sheet printed by the printhead 7. The spur 13 on the downstream side is biased against the discharge roller 9, and no discharge roller 9 is arranged at a position facing the spur 12 on the upstream side. The spur 12 is used to prevent the upward displacement of the printing sheet 1, and is also referred to as a pressing spur.

A conveyance guide 15 and a flapper 20 guide the printing sheet 1 between a feeding nip portion formed by the intermediate roller 3 and intermediate driven roller 4 and a conveyance nip portion formed by the conveyance roller 5 and pinch roller 6. The flapper 20 is pivotable by the reaction force of the printing sheet conveyed by the intermediate roller 3. The conveyance guide 15 guides the printing sheet 1. A sheet detection sensor 16 detects the leading edge of the sheet in the conveyance path. The sheet detection sensor 16 is provided downstream of the intermediate roller 3 in the sheet conveyance direction. A sheet leading/trailing edge detection sensor 14 detects the leading edge and trailing edge of the printing sheet 1. The sheet leading/trailing edge detection sensor 14 is provided upstream of the conveyance roller 5 in the sheet conveyance direction, and is configured to be pivotable in the same direction as the printing sheet conveyance direction. Note that an printing sheet position management arrangement is not limited to the arrangement using the sheet detection sensor and the sheet leading/trailing edge detection sensor 14. For example, one (sheet leading/trailing edge detection sensor 14) of the sensors can be used to manage the position of the printing sheet.

Figure 7:
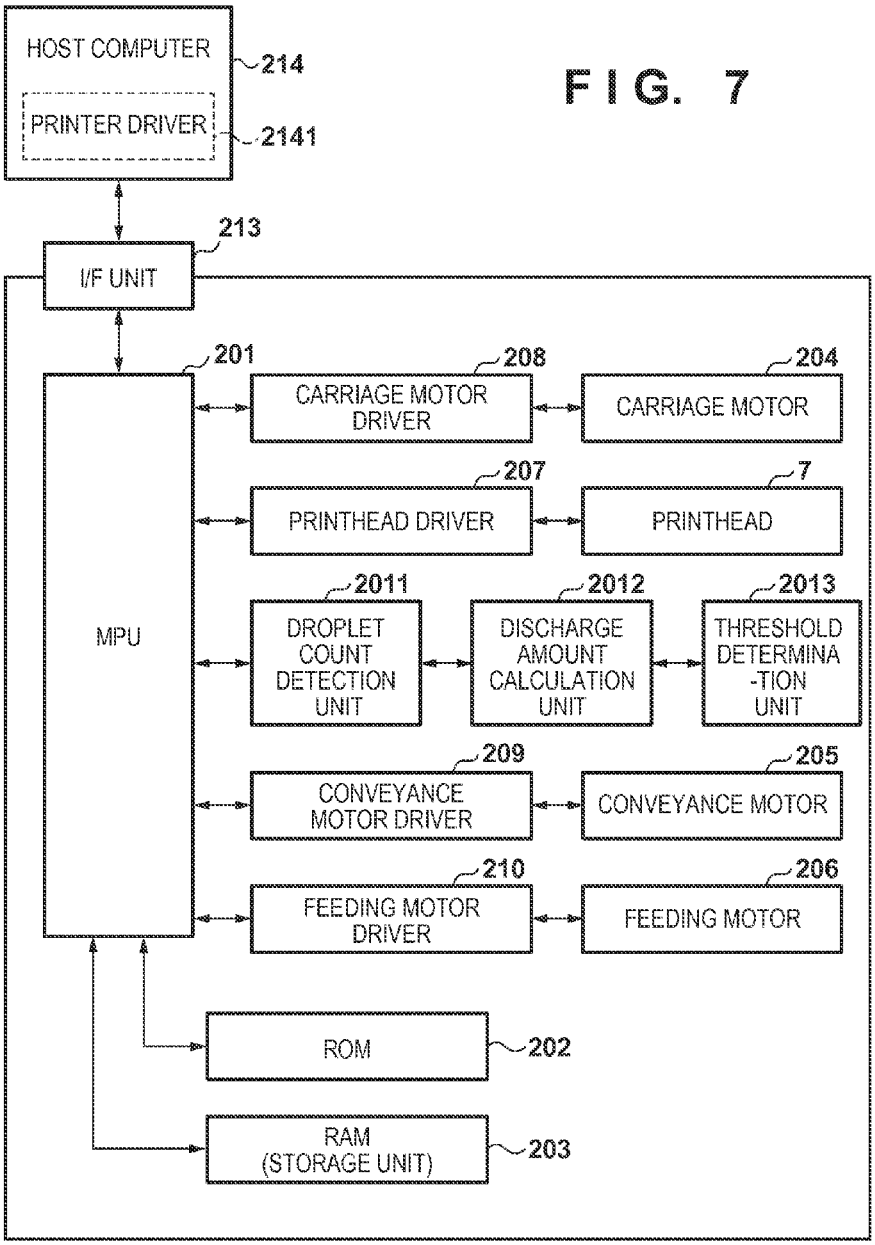
FIG. 7 is a block diagram showing the printing apparatus according to the embodiment.

FIG. 7 is a block diagram showing the printing apparatus according to this embodiment. An MPU 201 controls the operation of each unit, data processing, and the like. As will be described later, the MPU 201 also functions as a conveyance control unit capable of controlling reversing conveyance of the printing sheet so as to print on the second surface (for example, the back surface) of the printing sheet after printing on the first surface (for example, the front surface) of the printing sheet. The MPU 201 can control the driving speed of a reversing roller based on the ink discharge amount on the first surface of the printing sheet. The MPU 201 can control to decrease a driving speed of the reversing roller in a case where the ink discharge amount on the first surface of the printing sheet is equal to or larger than a threshold, as compared with a driving speed of the reversing roller in a case where the ink discharge amount is smaller than the threshold. That is, the MPU 201 can drive the reversing roller so as to decrease a driving speed of the reversing roller in a case where the ink discharge amount on the first surface of the printing sheet is equal to or larger than a threshold, as compared with a driving speed of the reversing roller in a case where the ink discharge amount is smaller than the threshold. A ROM 202 stores data and programs to be executed by the MPU 201. A RAM 203 temporarily stores processing data to be executed by the MPU 201 and data received from a host computer 214. Furthermore, when the printhead 7 prints on the second surface after printing on the first surface, the MPU 201 can control the driving speeds of the conveyance roller 5, a reversing roller 21, and the intermediate roller 3 based on the ink discharge amount at the time of printing on the first surface. The reversing roller 21 can reverse the printing sheet conveyed by the second conveyance operation.

A printhead driver 207 controls the printhead 7. A carriage motor driver 208 controls a carriage motor 204 for driving the carriage 10. A conveyance motor 205 drives the conveyance roller 5 and discharge roller 9. A conveyance motor driver 209 controls the conveyance motor 205. A feeding motor 206 drives the feeding roller 2 and intermediate roller 3. A feeding motor driver 210 controls the feeding motor 206.

In the host computer 214, a printer driver 2141 is provided to communicate with the printing apparatus by collecting printing information such as a printing image and printing image quality when the user instructs to execute a printing operation. The MPU 201 exchanges the printing image and the like with the host computer 214 via an I/F unit 213.

A droplet count detection unit 2011 detects (counts) an ink droplet count at the time of printing on a first surface 1-A of the printing sheet. A discharge amount calculation unit 2012 calculates an ink discharge amount (Duty A) based on the droplet count detected by the droplet count detection unit 2011 and a predetermined reference discharge amount. The ROM 202 stores tables (reversing speed selection tables) for associating the ink discharge amount with the driving speeds of the conveyance roller 5, reversing roller 21, and intermediate roller 3. The MPU 201 refers to the reversing speed selection tables (TB1 and TB2 of FIG. 9) based on the ink discharge amount calculation result of the discharge amount calculation unit 2012. The MPU 201 determines a speed corresponding to the discharge amount at the time of printing on the first surface, and controls the driving speeds of the respective rollers (conveyance roller 5, reversing roller 21, and intermediate roller 3) at the time of a reversing operation.

A threshold determination unit 2013 compares the ink discharge amount calculated by the discharge amount calculation unit 2012 with a preset threshold, and determines whether the ink discharge amount exceeds the threshold. The MPU 201 refers to reversing speed selection tables (TB3 of FIG. 12 and TB2 of FIG. 9). The MPU 201 determines a speed corresponding to the discharge amount at the time of printing on the first surface based on the determination result of the threshold determination unit 2013 and the ink discharge amount calculation result of the discharge amount calculation unit 2012. The MPU 201 controls the driving speeds of the respective rollers (conveyance roller 5, reversing roller 21, and intermediate roller 3) at the time of the reversing operation based on the determined speed.

The reversing operation will be described in time series with reference to ST1 of FIG. 1 to ST10 of FIG. 5. When the host computer 214 transmits printing data via the I/F unit 213, the printing data is processed by the MPU 201, and then loaded into the RAM 203. The MPU 201 starts a printing operation based on the loaded data.

Figure 2:
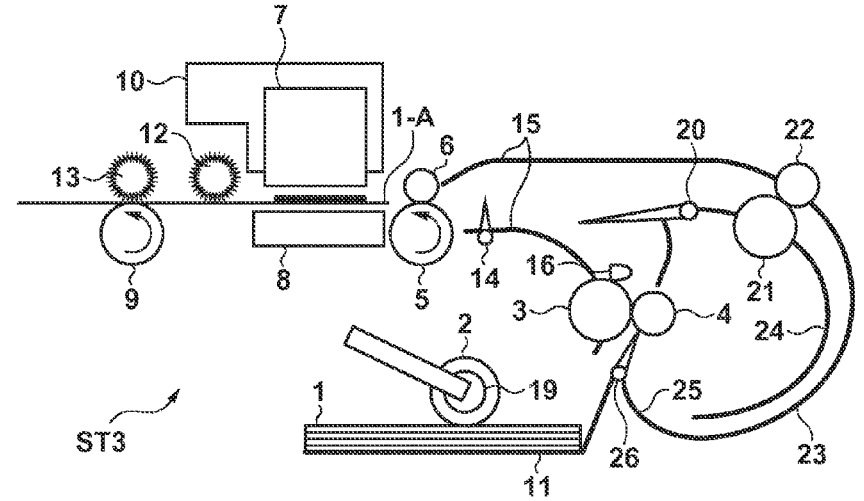
FIG. 2 is a view for explaining the printing sheet reversing operation in the printing apparatus according the embodiment.
Figure 2:
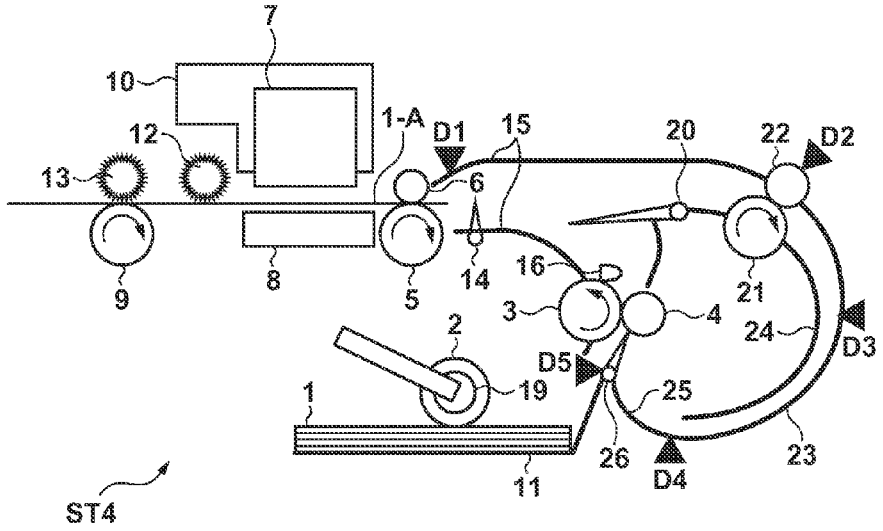

A description will be provided with reference to ST1 of FIG. 1 to ST3 of FIG. 2. The feeding motor driver 210 drives the feeding motor 206 at low speed. This rotates the feeding roller 2 at 7.6 inches/sec. When the feeding roller 2 rotates, the top printing sheet 1 stacked on the feeding tray 11 is picked up. The printing sheet 1 picked up by the feeding roller 2 is fed by the intermediate roller 3 rotating in the same direction as that of the feeding roller 2. The feeding motor 206 also drives the intermediate roller 3. This embodiment will be described by using an arrangement including the feeding roller 2 and the intermediate roller 3. However, an arrangement including only a feeding roller for feeding the printing sheet stacked on the stacking unit may be adopted.

When the sheet detection sensor 16 provided on the downstream side of the intermediate roller 3 detects the leading edge of the printing sheet 1, the feeding motor 206 is switched to high-speed driving. That is, the feeding roller 2 and intermediate roller 3 rotate at 20 inches/sec. When the intermediate roller 3 is continuously rotated, the conveyance guide 15 and flapper 20 guide the leading edge of the printing sheet. After the leading edge of the printing sheet is detected by the sheet leading/trailing edge detection sensor 14, it abuts against the conveyance nip portion formed by the conveyance roller 5 and pinch roller 6. At this time, the conveyance roller 5 stops. Even after the leading edge of the printing sheet abuts against the conveyance nip portion, the feeding motor 206 is rotated. Alignment of the printing sheet is performed to correct the skew while the leading edge of the printing sheet abuts against the conveyance nip portion.

Upon end of the skew correction operation of the printing sheet, the conveyance motor 205 is driven to start rotation of the conveyance roller 5. After the printing sheet having undergone the skew correction operation is aligned with a predetermined position on the platen 8 facing the printhead 7, a printing operation is performed by discharging ink from the printhead 7 based on the printing data. Note that the alignment operation is performed by making the leading edge of the printing sheet abut against the conveyance nip portion to temporarily position the printing sheet at the position of the conveyance roller 5, and controlling the rotation amount of the conveyance roller 5 with reference to the position of the conveyance roller 5.

In ST2 of FIG. 1, the printing operation of the printing sheet is performed by repeating a conveyance operation of intermittently conveying the printing sheet by a predetermined amount using the conveyance roller 5 and an image forming operation of discharging ink from the printhead 7 while moving the carriage 10 incorporating the printhead 7 when the conveyance roller 5 stops.

In ST3 of FIG. 2, upon end of the printing operation of the printing sheet, rotation of the conveyance roller 5 and discharge roller 9 stops. The discharge roller 9 and spur 13 hold the printing sheet whose trailing edge has passed through the conveyance nip portion formed by the conveyance roller 5 and the pinch roller 6. At this time, the flapper 20 is at a position where it moves down by its own weight, as shown in ST3 of FIG. 2, and guides the printing sheet to reversing conveyance guides 23 and 24.

Figure 8:
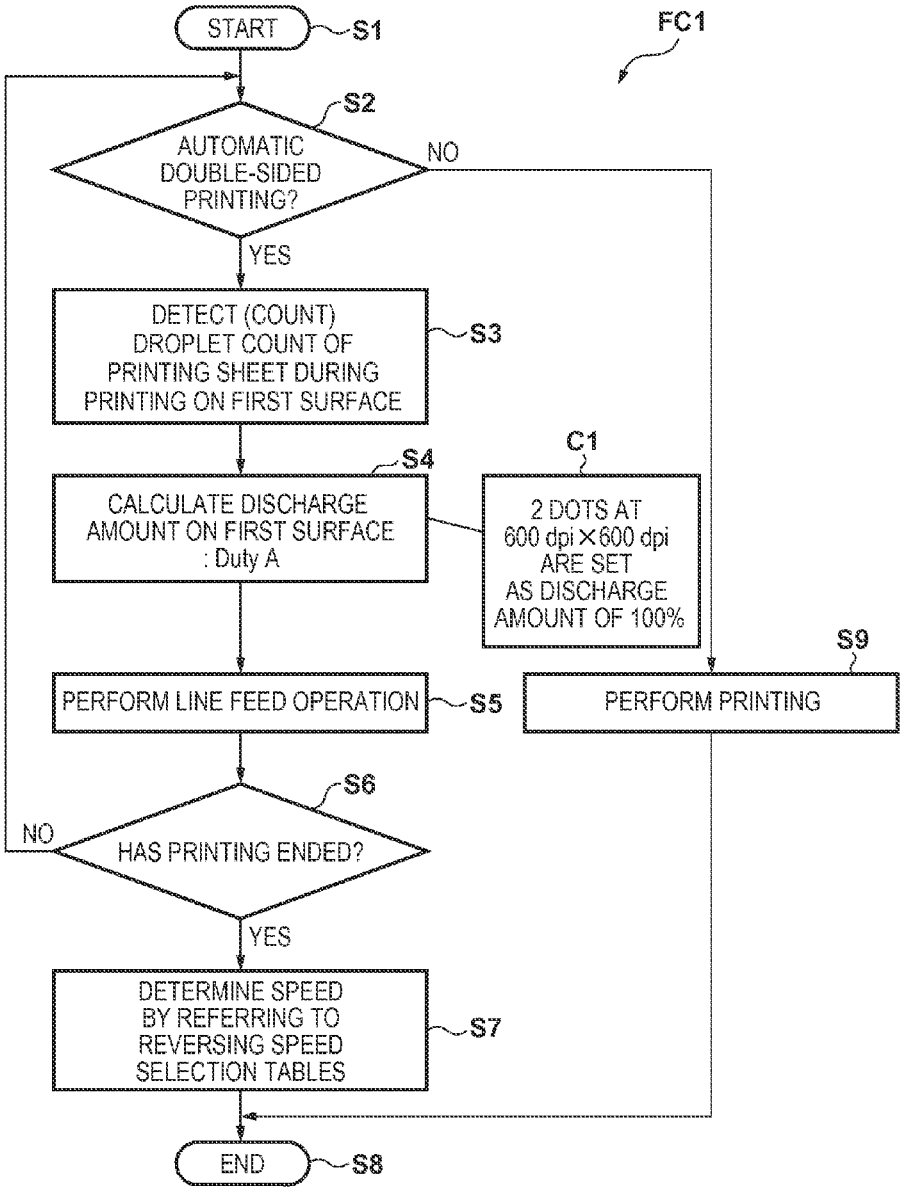
FIG. 8 is a flowchart for explaining a processing procedure of determining the speed at the time of reversing conveyance after printing on the first surface in the printing apparatus according to the embodiment.

A processing procedure of determining a speed at the time of reversing conveyance after printing on the first surface 1-A will be described with reference to a flowchart (FC1) shown in FIG. 8. Assume that this processing is executed under the overall control of the MPU 201, droplet count detection unit 2011, and discharge amount calculation unit 2012. In step S1, upon receiving a printing start instruction, the printing apparatus starts printing. In step S2, it is determined whether printing is automatic double-sided printing. If printing is not automatic double-sided printing (NO in step S2), printing is performed in step S9, thereby terminating the processing (step S8).

If printing is automatic double-sided printing (YES in step S2), the process advances to step S3. In step S3, an ink droplet count is detected (counted) during printing on the first surface 1-A of the printing sheet. In step S4, the ink discharge amount (Duty A) is calculated by referring to the predetermined reference discharge amount (C1). Assume that the reference discharge amount is stored in advance in the ROM 202.

In step S5, a line feed operation is performed. If it is determined in step S6 that printing has not ended (NO in step S6), the process returns to step S2 to repeat the same processing. On the other hand, if it is determined in step S6 that printing on the first surface 1-A has ended (YES in step S6), the process advances to step S7. In step S7, the MPU 201 determines a speed corresponding to the discharge amount (Duty A) at the time of printing on the first surface by referring to the reversing speed selection tables (TB1 and TB2) shown in FIG. 9, and advances the process to step S8, thereby terminating the processing. When printing on the second surface after printing on the first surface, the speeds of the conveyance roller 5, reversing roller 21, and intermediate roller 3 are controlled based on the speed determined in step S7.

The MPU 201 determines one of DV1 to DV4 as a reversing operation speed in accordance with the discharge amount (Duty A). For example, if the discharge amount Duty A of the printing sheet is smaller than the first threshold, the MPU 201 selects DV1 as a reversing operation speed. If the discharge amount Duty A of the printing sheet falls within the range from the first threshold (inclusive) to the second threshold (exclusive) (first threshold≤A<second threshold), the MPU 201 selects DV2 as a reversing operation speed.

When a reversing operation speed is selected by referring to the reversing speed selection table (TB1), the MPU 201 determines the speeds of the respective rollers (conveyance roller 5, reversing roller 21, and intermediate roller 3) at the time of the reversing operation by referring to the reversing speed selection table (TB2: selection table list). For example, if the discharge amount Duty A of the printing sheet falls within the range from the first threshold (inclusive) to the second threshold (exclusive) (first threshold≤A<second threshold), the selected reversing operation speed is DV2. Based on the settings of the reversing speed selection table (TB2), at the time of the reversing operation, the speed of the conveyance roller 5 is 5.33 inches/sec, and the speeds of the reversing roller 21 and intermediate roller 3 are 5.73 inches/sec.

As a comparative example, the behavior of the printing sheet when the reversing operation speed is not switched according to the reversing speed selection tables (TB1 and TB2) will be explained. When the discharge amount on the first surface 1-A becomes large by, for example, printing on the entire region of the printing sheet (when A≥third threshold in the reversing speed selection table (TB1)), the printing sheet readily deflects (the rigidity of the printing sheet decreases) due to ink discharged by printing on the first surface 1-A. In this state, when the printing sheet is reversed, it may deflect and the conveyance forces of the various rollers may not be correctly transferred to the printing sheet. Furthermore, due to the resistance from the reversing conveyance guide 23 or 24 to the trailing edge of the first surface 1-A (the leading edge of a second surface 1-B) of the printing sheet 1, the leading edge of the second surface 1-B may deflect or may be folded, or change the conveyance direction of the reversed printing sheet, thereby causing a conveyance failure.

To the contrary, when the ink discharge amount at the time of printing on the first surface 1-A is small and the deflection strength (rigidity) of the printing sheet is not decreased, if the speeds of the respective rollers are uniformly decreased, it may take time to start printing on the second surface 1-B, thereby degrading the throughput of the printing apparatus. With reference to the reversing speed selection tables (TB1 and TB2), based on the reversing operation speed corresponding to the ink discharge amount at the time of printing on the first surface, the speeds of the respective rollers (conveyance roller 5, reversing roller 21, and intermediate roller 3) at the time of the reversing operation are controlled. This can convey the reversed printing sheet to the printing region without causing a conveyance failure, and perform printing on the second surface even if the flexibility of the printing sheet changes due to printing on the first surface.

When executing double-sided continuous printing, the MPU 201 controls to reverse the printing surface of the printing sheet from the first surface to the second surface (reverse the printing sheet) after the end of the printing operation of the first surface of the printing sheet (ST3 of FIG. 2). The MPU 201 conveys the printing sheet in a conveyance direction at the time of the reversing operation, which is opposite to the conveyance direction at the time of the printing operation, from the side of the conveyance roller 5 to the side of the intermediate roller 3 via the flapper 20, the reversing conveyance guides 23 and 24, a reversing re-feed path guide 25, and a reversing re-feed flapper 26. The reversing conveyance guides 23 and 24 reverse the printing sheet from the first surface to the second surface, thereby setting the second surface of the printing sheet as a printing surface. The MPU 201 guides the reversed printing sheet by the reversing re-feed path guide 25, and rotates the pivotably supported reversing re-feed flapper 26 to convey the printing sheet from the side of the intermediate roller 3 to the side of the conveyance roller 5.

Practical processing at the time of the reversing operation will be described below with reference to ST4 of FIG. 2 to ST10 of FIG. 5. Reference symbols D1 to D5 in ST4 of FIG. 2 to ST10 of FIG. 5 denote speed switching points at the time of the reversing operation. Assume that a detection unit (printing sheet detection unit) for detecting a printing sheet is arranged near each speed switching point. The detection unit (printing sheet detection unit) is arranged in a conveyance path through which the printing sheet is conveyed at the time of the reversing operation, and detects the printing sheet. When one of the detection units detects that the printing sheet has passed through a corresponding one of the speed switching points D1 to D5, the MPU 201 can control the speeds of the respective rollers (conveyance roller 5, reversing roller 21, and intermediate roller 3) at the time of the reversing operation based on the detection result of the detection unit.

The speed switching point D1 indicates a position immediately after the reversing operation starts and the printing sheet enters the conveyance nip portion formed by the conveyance roller 5 and pinch roller 6. This speed switching point D1 is a position where a conveyance failure may occur due to the resistance from the conveyance roller 5, conveyance guide 15, or flapper 20 to the printing sheet. Note that the position of the speed switching point D1 is not limited to that shown in ST4 to ST10, and may be arranged so as to detect the printing sheet at a position before the printing sheet enters the conveyance nip portion.

The speed switching point D2 indicates a position immediately after the printing sheet enters a nip portion formed by the reversing roller 21 and a reversing pinch roller 22. This speed switching point D2 is a position where a conveyance failure may occur due to the resistance from the reversing conveyance guide 23 or 24 to one edge of the printing sheet. Note that the position of the speed switching point D2 is not limited to that shown in ST4 to ST10, and may be arranged so as to detect the printing sheet at a position before the printing sheet enters the nip portion.

The speed switching point D3 indicates a position where the printing sheet conveyance direction is reversed. This speed switching point D3 is a position where a conveyance failure may occur due to the resistance from the reversing conveyance guide 23 or 24 to one edge of the printing sheet.

The speed switching point D4 indicates a position where the resistance from the reversing re-feed path guide 25 to the printing sheet becomes high after the printing sheet conveyance direction is reversed. This speed switching point D4 is a position where a conveyance failure may occur due to the resistance from the reversing re-feed path guide 25.

The speed switching point D5 indicates a position near the pivoting unit of the reversing re-feed flapper 26. This speed switching point D5 is a position where a conveyance failure may occur due to the resistance when the printing sheet guided by the reversing re-feed path guide 25 pivots about the reversing re-feed flapper 26.

Before the start of reversing conveyance, the MPU 201 determines a speed (reversing operation speed) corresponding to the ink discharge amount with reference to the reversing speed selection tables (TB1 and TB2). This processing corresponds to the processing in step S7 of FIG. 8. In ST4 of FIG. 2, reversing conveyance is performed by controlling the speeds of the conveyance roller 5, reversing roller 21, and intermediate roller 3 based on the reversing operation speed determined with reference to the reversing speed selection tables (TB1 and TB2). In reversing conveyance, the MPU 201 controls to switch the reversing operation speed at one of the above-described speed switching points D1 to D5. The conveyance roller 5 and discharge roller 9 reversely rotate in a direction (the clockwise direction in FIG. 2) opposite to that at the time of the printing operation to cause the printing sheet to re-enter the conveyance nip portion of the conveyance roller 5 and pinch roller 6, thereby conveying the printing sheet toward the conveyance guide 15 and flapper 20. For example, when the reversing operation speed is switched at the speed switching point D1, the rotation speed of the conveyance roller 5 is controlled to the reversing operation speed determined with reference to the reversing speed selection tables (TB1 and TB2). When the conveyance roller 5 and discharge roller 9 start to reversely rotate, the intermediate roller 3 also rotates (in the counterclockwise direction in ST4 of FIG. 2). In addition, when the conveyance roller 5 and discharge roller 9 start to reversely rotate, the reversing roller 21 also rotates (in the clockwise direction in ST4 of FIG. 2). At this time, the rotation speeds of the intermediate roller 3 and reversing roller 21 are controlled to the reversing operation speed determined with reference to the reversing speed selection tables (TB1 and TB2).

Figure 3:
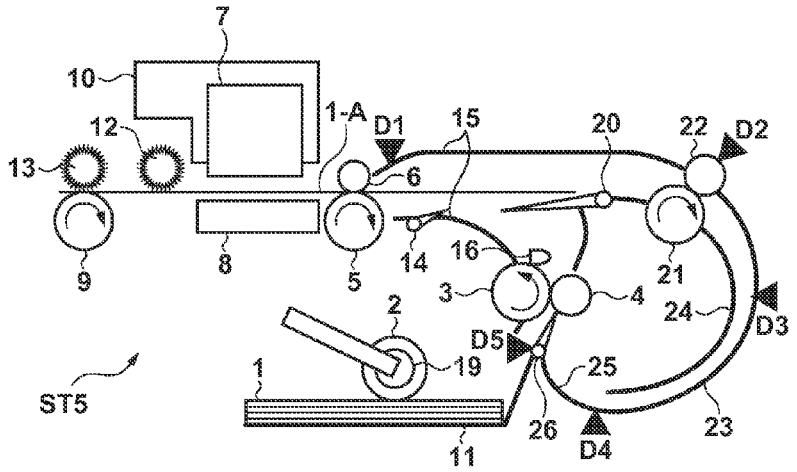
FIG. 3 is a view for explaining the printing sheet reversing operation in the printing apparatus according the embodiment.
Figure 3:
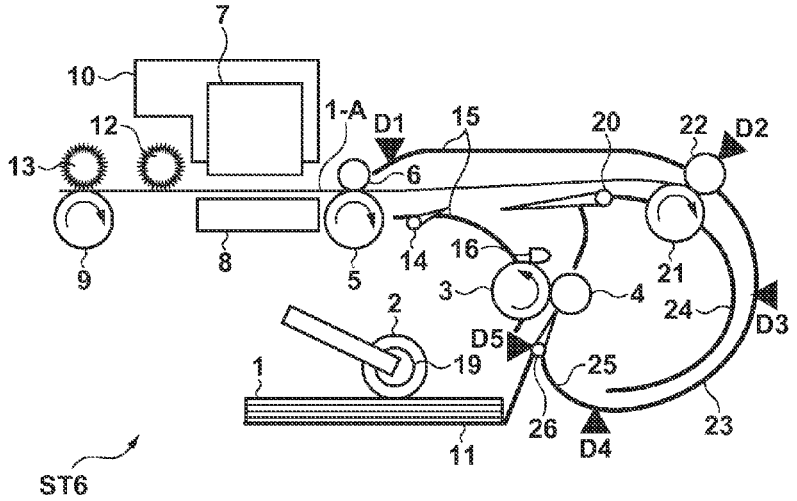

In ST5 of FIG. 3, when the conveyance roller 5 continuously rotates in the clockwise direction in FIG. 3, one edge (the trailing edge at the time of printing on the first surface) of the printing sheet is guided by the flapper 20 and conveyance guide 15 toward the reversing conveyance guides 23 and 24. The flapper 20 is configured to be rotatable while it is in contact with the printing sheet when the printing sheet is conveyed in the conveyance direction at the time of the reversing operation.

In ST6 of FIG. 3, when the conveyance roller 5 further continuously rotates in the clockwise direction in FIG. 3, one edge (the trailing edge at the time of printing on the first surface) of the printing sheet is conveyed to the reversing roller 21 and reversing pinch roller 22, and enters the nip portion formed by the reversing roller 21 and reversing pinch roller 22.

Figure 4:
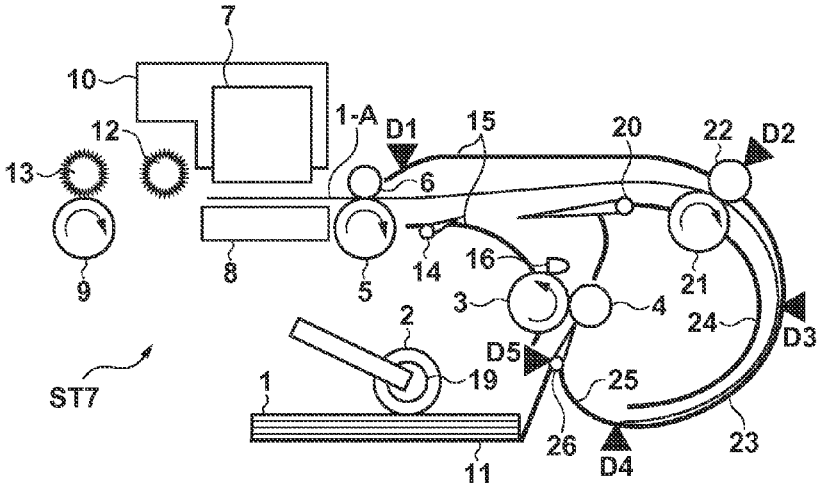
FIG. 4 is a view for explaining the printing sheet reversing operation in the printing apparatus according the embodiment.
Figure 4:
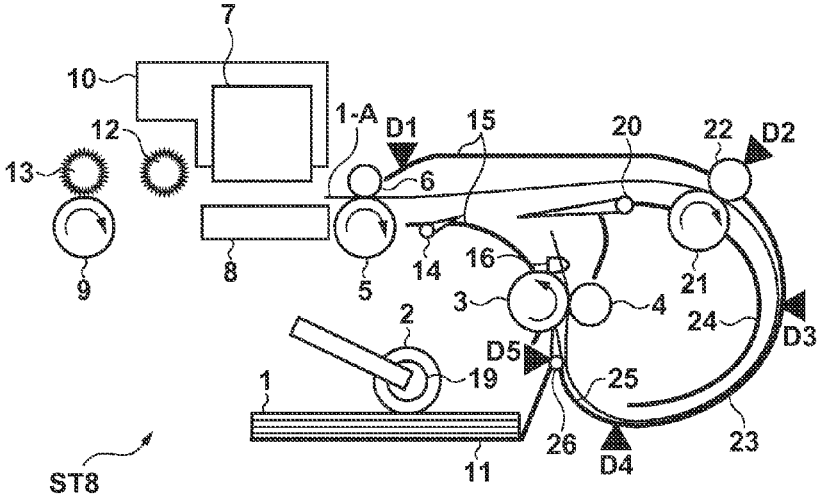

In ST7 of FIG. 4, when the conveyance roller 5 and reversing roller 21 further continuously rotate in the clockwise direction in FIG. 4, one edge (the trailing edge at the time of printing on the first surface) of the printing sheet is guided by the reversing conveyance guides 23 and 24. In ST8 of FIG. 4, when the conveyance roller 5 and reversing roller 21 further continuously rotate in the clockwise direction in FIG. 4, one edge (the trailing edge at the time of printing on the first surface) of the printing sheet is guided by the reversing re-feed path guide 25, and reaches the reversing re-feed flapper 26. The reversing re-feed flapper 26 is configured to be rotatable while it is in contact with the printing sheet when the printing sheet is conveyed in the conveyance direction at the time of the reversing operation. The reversing re-feed flapper 26 rotates while it is in contact with the printing sheet, and one edge (the trailing edge at the time of printing on the first surface) of the printing sheet enters the feeding nip portion formed by the intermediate roller 3 and intermediate driven roller 4. The sheet detection sensor 16 detects one edge (the trailing edge at the time of printing on the first surface) of the printing sheet which has passed through the feeding nip portion. When the sheet detection sensor 16 detects one edge (the trailing edge at the time of printing on the first surface) of the printing sheet, the MPU 201 manages the leading edge position from there, and controls the driving amounts of the intermediate roller 3 and conveyance roller 5.

Figure 5:
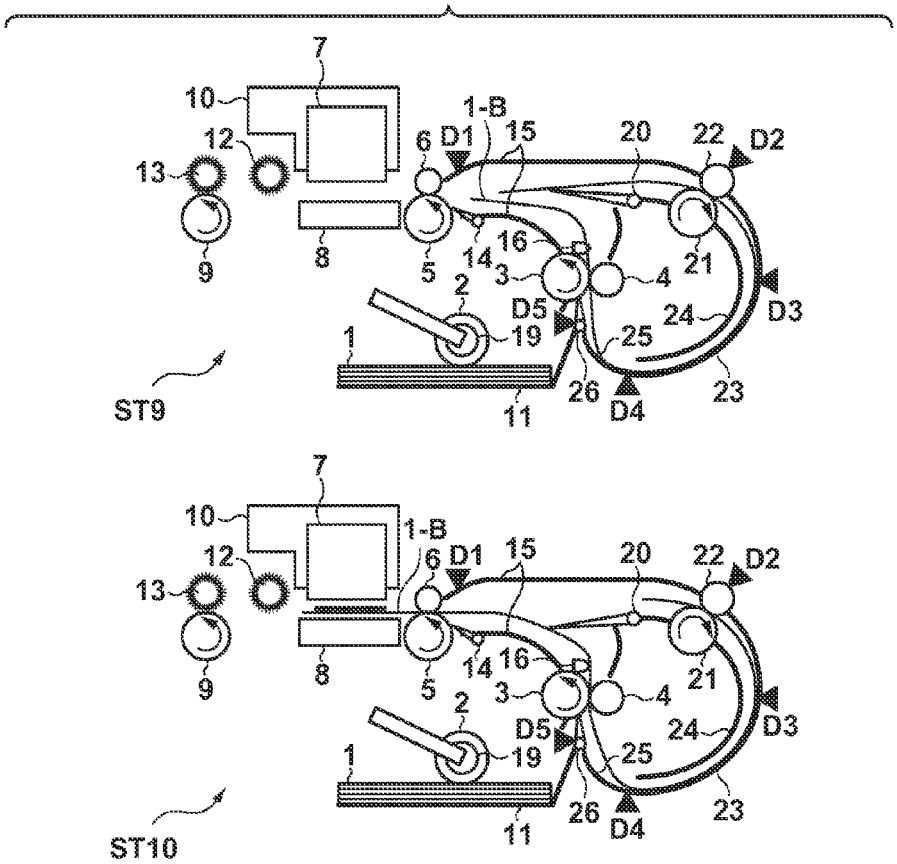
FIG. 5 is a view for explaining the printing sheet reversing operation in the printing apparatus according the embodiment.

In ST9 of FIG. 5, by continuously rotating (in the counterclockwise direction) the intermediate roller 3, one edge (the trailing edge at the time of printing on the first surface) of the printing sheet is guided by the flapper 20, and re-fed to the conveyance guide 15. When the intermediate roller 3 is further continuously rotated, one edge of the printing sheet abuts against the conveyance nip portion formed by the conveyance roller 5 and pinch roller 6 to perform skew correction, as in ST1 described with respect to printing on the first surface.

Upon end of the skew correction operation of the printing sheet, the conveyance motor 205 is driven to start rotation of the conveyance roller 5 in ST10 of FIG. 5. The printing sheet is aligned with the position facing the printhead 7. At this time, the surface of the printing sheet facing the printhead 7 is the second surface which is opposite to the printed first surface and is white paper. The printing operation of the second surface 1-B of the aligned printing sheet is performed by discharging ink from the printhead 7 based on the printing data.

According to this embodiment, the speeds of the respective rollers (conveyance roller 5, reversing roller 21, and intermediate roller 3) at the time of the reversing operation are controlled based on the reversing operation speed corresponding to the ink discharge amount on the first surface 1-A. This allows printing on the second surface by conveying the reversed printing sheet to the printing region without causing a conveyance failure even if the printing sheet readily deflects due to printing on the first surface.

Second Embodiment

In this embodiment, an arrangement for calculating an ink discharge amount for each of a plurality of partial regions obtained by dividing the first surface of a printing sheet will be described. The arrangement of a printing apparatus according to this embodiment is the same as that in the first embodiment.

Figure 10A:
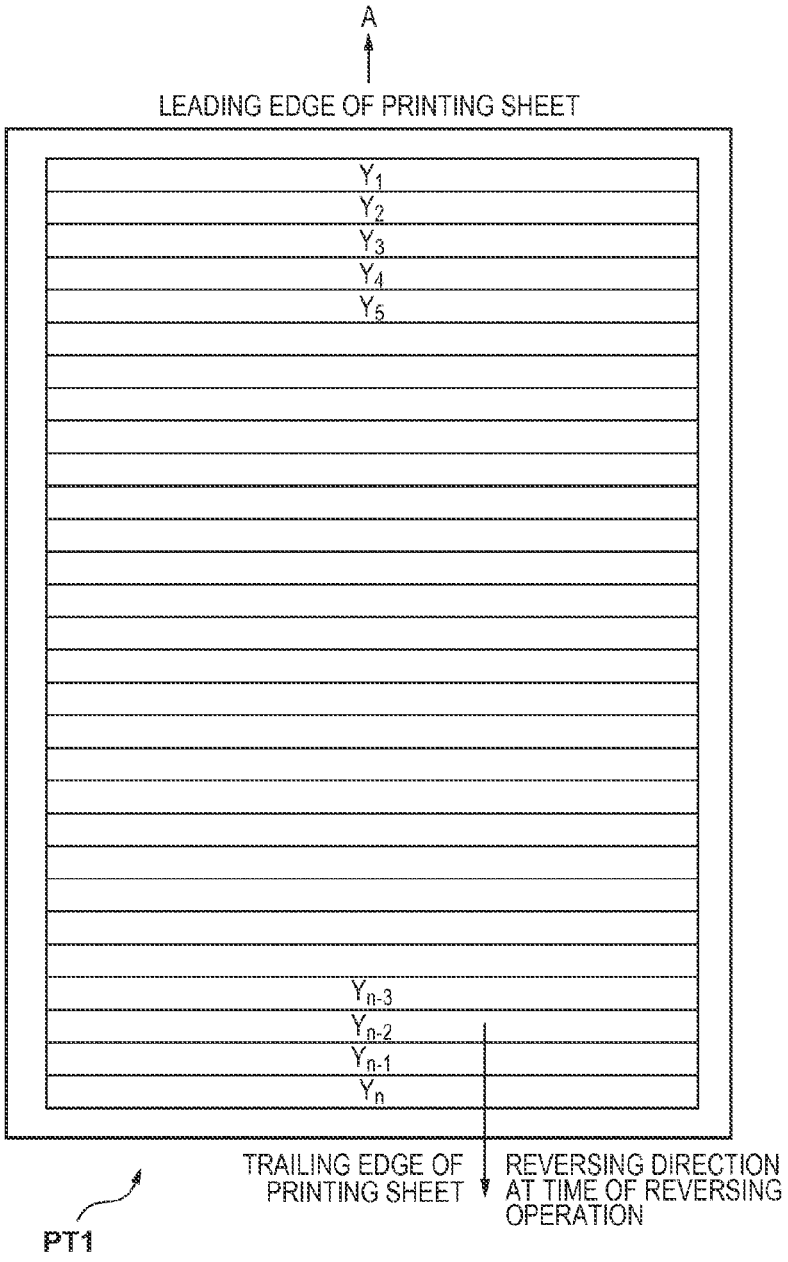
FIGS. 10A and 10B are views for explaining an arrangement obtained by dividing the first surface of the printing sheet into a plurality of partial regions.
Figure 10B:
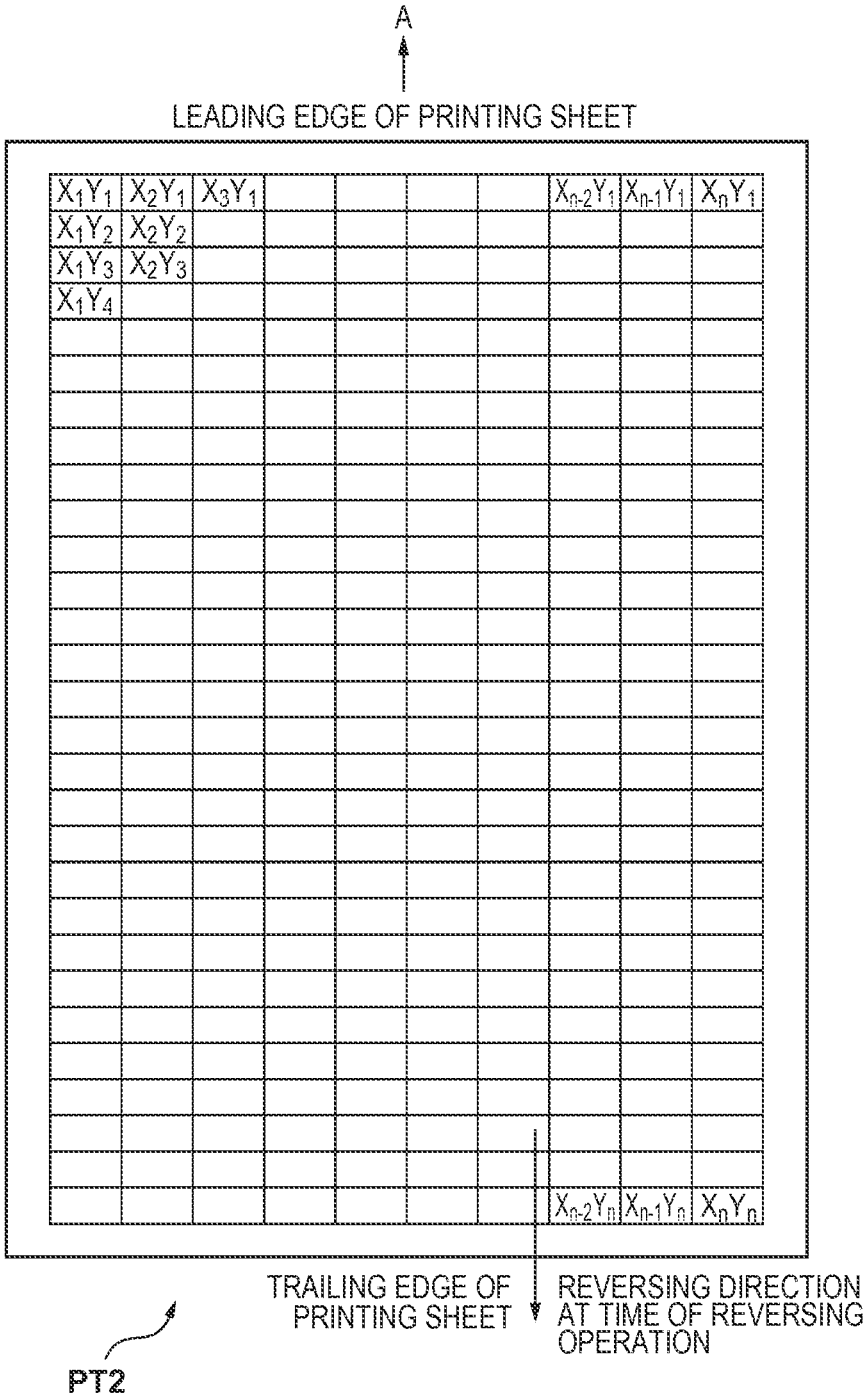

FIGS. 10A and 10 are views for explaining an arrangement obtained by dividing the first surface of a printing sheet into a plurality of partial regions. Referring to FIGS. 10A and 10B, an arrow A indicates the conveyance direction (sub-scanning direction) of the printing sheet, and the moving direction of a carriage 10 is a direction (main-scanning direction) intersecting the conveyance direction (sub-scanning direction) of the printing sheet. In PT 1 of FIG. 10A, the plurality of partial regions are obtained by dividing the printing sheet along the conveyance direction (sub-scanning direction) of the printing sheet (Y1, Y2, . . . , Yn). The partial regions divided along the conveyance direction (sub-scanning direction) of the printing sheet will be referred to as areas hereinafter. In PT2 of FIG. 10B, an example of an arrangement obtained by dividing each of the partial regions (areas) in the sub-scanning direction into a plurality of partial regions (subareas) along the width direction (a direction corresponding to the main-scanning direction) of the printing sheet (X1Y1, . . . , XnYn) is shown. In PT1 and PT2, the plurality of partial regions (areas or subareas) cover the entire printing region on the first surface of the printing sheet.

A droplet count detection unit 2011 detects an ink droplet count for each of the plurality of partial regions obtained by dividing the first surface of the printing sheet. Based on the droplet count detected for each partial region and a predetermined reference discharge amount, a discharge amount calculation unit 2012 calculates an ink discharge amount in the partial region. In addition, the discharge amount calculation unit 2012 can calculate the ink discharge amount based on the reference discharge amount and a value obtained by multiplying the droplet count by a weighting coefficient set for each ink color.

A processing procedure of calculating the ink discharge amount in each partial region, and determining a speed at the time of reversing conveyance after printing on the first surface by using the discharge amount calculation result will be described with reference to a flowchart (FC2) shown in FIG. 11. Assume that this processing is executed under the overall control of an MPU 201, the droplet count detection unit 2011, the discharge amount calculation unit 2012, and a threshold determination unit 2013, and the arrangement of the plurality of partial regions (areas) shown in PT1 of FIG. 10A will be exemplified.

Figure 11:
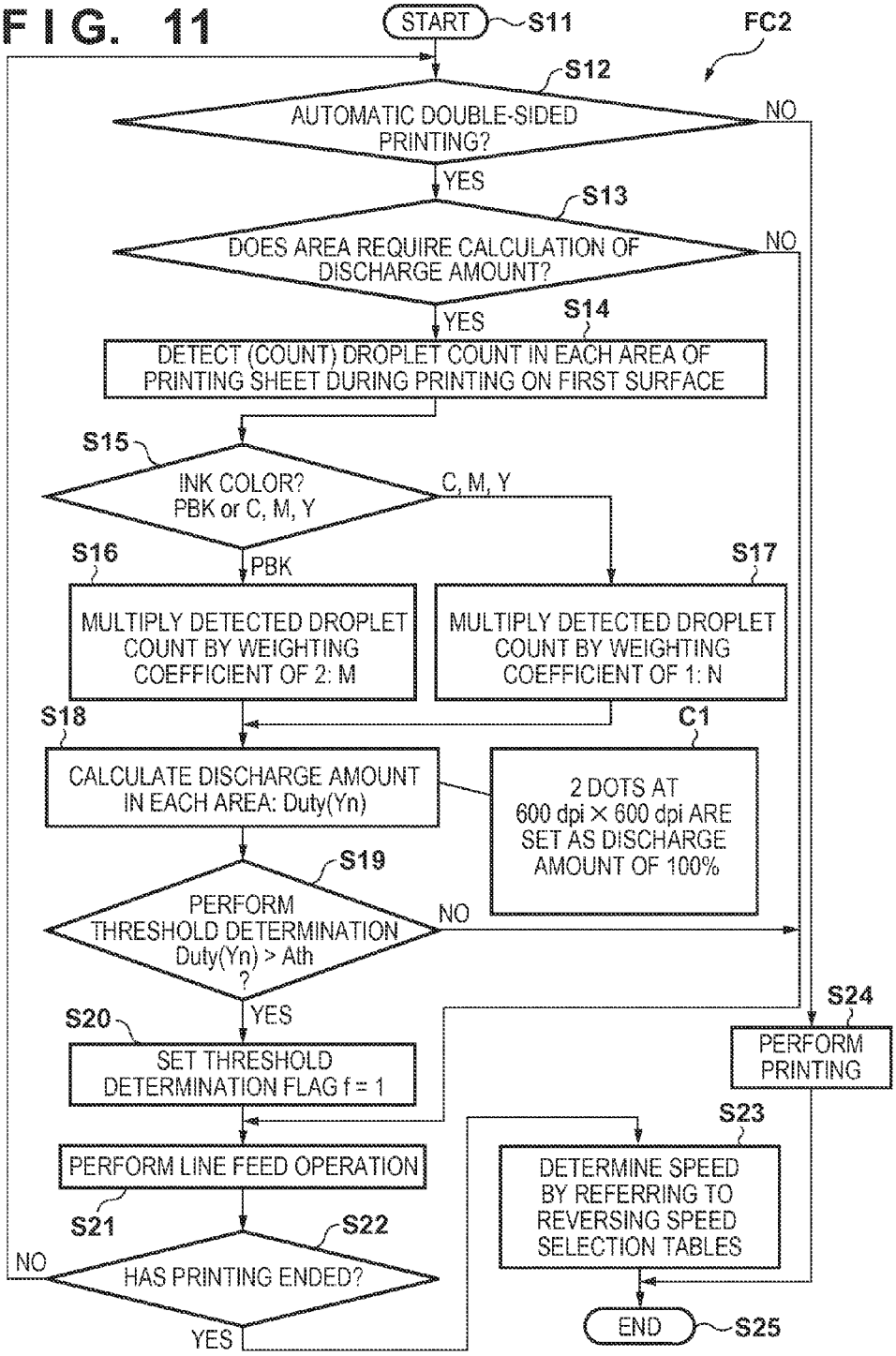
FIG. 11 is a flowchart for explaining a processing procedure of determining the speed at the time of reversing conveyance after printing on the first surface by using the result of calculating an ink discharge amount in each partial region.

Referring to FIG. 11, in step S11, upon receiving a printing start instruction, the printing apparatus starts printing. In step S12, it is determined whether printing is automatic double-sided printing. If printing is not automatic double-sided printing (NO in step S12), printing is performed in step S24, thereby terminating the processing (step S25).

If printing is automatic double-sided printing (YES in step S12), the process advances to step S13. In step S13, it is determined whether an area requires calculation of a discharge amount. If the area requires no calculation of a discharge amount (NO in step S13), the process advances to step S21; otherwise (YES in step S13), the process advances to step S14.

In step S14, a droplet count in each area (Y1, Y2, . . . , Y(n)) is detected (counted) during printing on the first surface. In step S15, the droplet count detected in step S14 is divided for respective ink colors. If the ink color is black (to be referred to as "PBK" hereinafter) (PBK in step S15), the process advances to step S16. On the other hand, if it is determined in step S15 that the ink color is cyan (to be referred to as "C" hereinafter), magenta (to be referred to as "M" hereinafter), or yellow (to be referred to as "Y" hereinafter) (C, M, Y in step S15), the process advances to step S17.

In step S16, the detected droplet count is multiplied by a weighting coefficient of 2 (a multiplication result is represented by M). In step S17, the detected droplet count is multiplied by a weighting coefficient of 1 (a multiplication result is represented by N).

In step S18, based on the total of the multiplication results M and N and the predetermined reference discharge amount (C1), an ink discharge amount (Duty1, . . . , Duty(Yn)) in each area (Y1, . . . , Y(n)) is calculated. In the above arrangement, the same weighting coefficient of 1 is used for the ink droplet counts of C, M, and Y but different weighting coefficients can be set for the respective ink colors of C, M, and Y.

In step S19, the ink discharge amount (Duty1, . . . , Duty(Yn)) calculated in step S18 is compared with a preset threshold Ath. The threshold determination unit 2013 compares the ink discharge amount (Duty1, . . . , Duty(Yn)) calculated by the discharge amount calculation unit 2012 with the preset threshold Ath, and determines whether the ink discharge amount exceeds the threshold. If the calculated ink discharge amount (Duty1, . . . , Duty(Yn)) does not exceed the threshold Ath (NO in step S19), the process advances to step S21; otherwise (YES in step S19), the process advances to step S20.

If it is determined in step S19 that the ink discharge amount exceeds the threshold, the threshold determination unit 2013 sets, in step S20, a flag indicating that the ink discharge amount exceeds the threshold. The threshold determination unit 2013 sets 1 in a threshold determination flag f(n) corresponding to each area. The ink discharge amount (Duty1, . . . , Duty(Yn)) calculated in step S18 is compared with the preset threshold Ath for each area (Y1, Y2, . . . , Y(n)). For each area, if the ink discharge amount (Duty1, . . . , Duty(Yn)) exceeds the threshold Ath, 1 is set in the threshold determination flag f(n) of the area.

In step S21, a line feed operation is performed. If it is determined in step S22 that printing has not ended (NO in step S22), the process returns to step S12 to repeat the same processing. On the other hand, if it is determined in step S22 that printing on the first surface 1-A has ended (YES in step S22), the process advances to step S23. In step S23, the speeds of respective rollers at the time of the reversing operation corresponding to the ink discharge amount are determined using the setting value of the threshold determination flag and the calculated ink discharge amount with reference to a reversing speed selection table (TB3) shown in FIG. 12, and the process advances to step S25, thereby terminating the processing.

The reversing speed selection table (TB3) is a table stored in a ROM 202, and associates an ink discharge amount and a speed corresponding to the number of flags. The MPU 201 controls the speeds of a conveyance roller 5, reversing roller 21, and intermediate roller 3 based on the speed determined based on the ink discharge amount and the number of set flags with reference to the reversing speed selection table (TB3). The number of flags in which "1" has been set among the threshold determination flags f1 to f(n) corresponds to the number of areas for which the threshold is exceeded. With reference to the reversing speed selection table (TB3), the MPU 201 determines one of reversing operation speeds DV1 to DV4 based on the number of threshold determination flags in which "1" has been set, and the largest one of the ink discharge amounts in the areas for which "1" has been set. The largest ink discharge amount is represented by a maximum Duty: Amax.

For example, among the threshold determination flags f1 to F(n), the number of flags in which "1" has been set (the number of areas in which the threshold is exceeded) is four. The largest one (maximum Duty: Amax) of the ink discharge amounts in the four areas (partial regions) falls within the range from the second threshold (inclusive) to the third threshold (exclusive) (second threshold≤Amax<third threshold), a selected reversing operation speed is DV3. Based on the settings of the reversing speed selection table (TB2 of FIG. 9), at the time of the reversing operation, the speed of the conveyance roller 5 is 3.33 inches/sec, and the speeds of the reversing roller 21 and intermediate roller 3 are 3.58 inches/sec.

Note that the arrangement of the plurality of partial regions shown in PT1 of FIG. 10A has been exemplified with reference to the flowchart shown in FIG. 11 but the present invention is not limited to this. For example, the present invention is equally applicable to the example of the arrangement obtained by dividing each of the plurality of partial regions (areas) along the conveyance direction of the printing sheet into a plurality of partial regions (subareas) along the width direction of the printing sheet, as shown in PT2 of FIG. 10B. In this case, in each subarea of each area, the ink discharge amount is calculated and compared with a threshold, and a threshold determination flag is set. The MPU 201 determines one of the reversing operating speeds DV1 to DV4 based on the number of threshold determination flags f in which "1" has been set (that corresponds to the number of areas for which the threshold is exceeded) with reference to the reversing speed selection table (TB3 of FIG. 12). The MPU 201 determines the speeds of the respective rollers (conveyance roller 5, reversing roller 21, and intermediate roller 3) based on the determined reversing operation speed (DV) with reference to the reversing speed selection table (TB2 of FIG. 9).

Practical processing when the speeds of the respective rollers (conveyance roller 5, reversing roller 21, and intermediate roller 3) are switched to comply with the reversing operation speed at the speed switching point D2 will be described with reference to ST4 of FIG. 2 to ST10 of FIG. 5.

In ST4 of FIG. 2, the conveyance roller 5 and a discharge roller 9 reversely rotate in a direction (the clockwise direction in FIG. 2) opposite to that at the time of the printing operation. The conveyance roller 5 reversely rotates at, for example, a speed of 7.5 inches/sec (a speed corresponding to DV1 in TB2 of FIG. 9) to cause the printing sheet to re-enter the conveyance nip portion of the conveyance roller 5 and pinch roller 6, thereby conveying the printing sheet toward a conveyance guide 15 and a flapper 20.

When the conveyance roller 5 and discharge roller 9 start to reversely rotate, the intermediate roller 3 also rotates (in the counterclockwise direction in ST4 of FIG. 2) (at, for example, 8.06 inches/sec corresponding to DV1 in TB2 of FIG. 9). In addition, when the conveyance roller 5 and discharge roller 9 start to reversely rotate, the reversing roller 21 also rotates (in the clockwise direction in ST4 of FIG. 2) (at, for example, 8.06 inches/sec corresponding to DV1 in TB2 of FIG. 9).

In ST5 of FIG. 3, when the conveyance roller 5 continuously rotates in the clockwise direction in FIG. 3, one edge (the trailing edge at the time of printing on the first surface) of the printing sheet is guided by the flapper 20 and conveyance guide 15 toward the reversing conveyance guides 23 and 24. At this time, the conveyance roller 5 continuously, reversely rotates at, for example, a speed of 7.5 inches/sec (corresponding to DV1 in TB2 of FIG. 9).

In step ST6 of FIG. 3, the conveyance roller 5 continuously rotates in the clockwise direction in FIG. 3 at 7.5 inches/sec (corresponding to DV1 in TB2 of FIG. 9), one edge (the trailing edge at the time of printing on the first surface) of the printing sheet is conveyed to the reversing roller 21 and a reversing pinch roller 22, and enters a nip portion formed by the reversing roller 21 and the reversing pinch roller 22.

When a detection unit (printing sheet detection unit) (not shown) detects that the printing sheet has entered the nip portion formed by the reversing roller 21 and reversing pinch roller 22, the MPU 201 controls the speeds of the respective rollers (conveyance roller 5, reversing roller 21, and intermediate roller 3) at the time of the reversing operation based on the detection result of the detection unit (printing sheet detection unit). For example, when the MPU 201 selects DV3 as a reversing operation speed, it controls the speed of the conveyance roller 5 to 3.33 inches/sec based on the settings of the reversing speed selection table (TB2 of FIG. 9). The MPU 201 controls the speeds of the reversing roller 21 and intermediate roller 3 to 3.58 inches/sec. The MPU 201 controls to decrease the conveyance speed (rotation speed) of the conveyance roller 5 from 7.5 inches/sec to 3.33 inches/sec. The MPU 201 controls to decrease the speeds (rotation speeds) of the reversing roller 21 and intermediate roller 3 from 8.06 inches/sec to 3.58 inches/sec.

Figure 6:
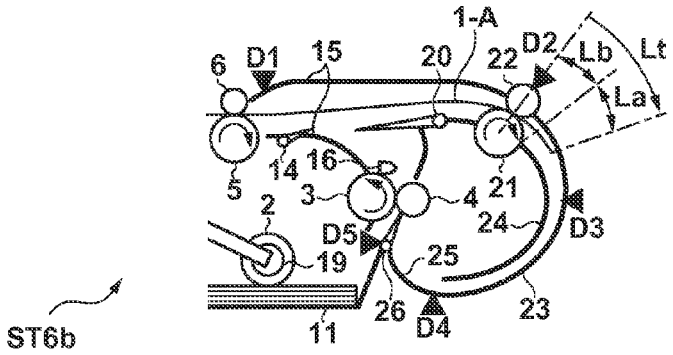
FIG. 6 is a view for explaining the behavior of a printing sheet during reversing conveyance when the roller speed is not switched.

As a comparative example, the behavior of the printing sheet during reversing conveyance when the speeds of the respective rollers are not switched will be explained with reference to ST6*b* of FIG. 6. For example, a region La on the first surface 1-A shown in FIG. 6 indicates a non-printing (white paper) region, and a region Lb on the first surface 1-A indicates a region (area) where the discharge amount Duty exceeds the threshold. The region Lb deflects more easily than the region La due to printing on the first surface.

Assume that one edge (the trailing edge at the time of printing on the first surface) of the printing sheet (the first surface 1-A) is conveyed by Lt from the speed switching point D2. When the reversing roller 21 rotates at a speed of, for example, 8.06 inches/sec, one edge (the trailing edge at the time of printing on the first surface) of the printing sheet (the first surface 1-A) is brought into contact with the reversing conveyance guide 23 or 24 during conveyance, and is thus subject to the resistance. The resistance may cause one edge (the trailing edge at the time of printing on the first surface) of the printing sheet (the first surface 1-A) to be folded in the region Lb, or change the conveyance direction of the printing sheet, thereby causing a conveyance failure. It is possible to reduce the resistance to one edge (the trailing edge at the time of printing on the first surface) of the printing sheet (the first surface 1-A), and prevent the occurrence of a conveyance failure by switching the rotation speed (for example, from 8.06 inches/sec to 3.58 inches/sec).

In ST7 of FIG. 4, when the conveyance roller 5 and reversing roller 21 further continuously rotate in the clockwise direction in FIG. 4 based on the speed controlled at the speed switching point D2, one edge (the trailing edge at the time of printing on the first surface) of the printing sheet is guided by the reversing conveyance guides 23 and 24. In ST8, when the conveyance roller 5 and reversing roller 21 continuously rotate in the clockwise direction in FIG. 4 based on the speed controlled at the speed switching point D2, one edge (the trailing edge at the time of printing on the first surface) of the printing sheet is guided by a reversing re-feed path guide 25, and reaches a reversing re-feed flapper 26.

In ST9 of FIG. 5, by continuously rotating (in the counterclockwise direction) the intermediate roller 3 based on the speed controlled at the speed switching point D2, one edge (the trailing edge at the time of printing on the first surface) of the printing sheet is guided by the flapper 20, and re-fed to the conveyance guide 15. When the intermediate roller 3 is further continuously rotated based on the speed controlled at the speed switching point D2, one edge of the printing sheet abuts against the conveyance nip portion formed by the conveyance roller 5 and pinch roller 6 to perform skew correction, as in ST1 described with respect to printing on the first surface.

Upon end of the skew correction operation of the printing sheet, a conveyance motor 205 is driven based on the speed controlled at the speed switching point D2 to start rotation of the conveyance roller 5 in ST10 of FIG. 5. The printing sheet is aligned with the position facing the printhead 7. At this time, the surface of the printing sheet facing the printhead 7 is the second surface opposite to the printed first surface. The printing operation of the second surface 1-B of the aligned printing sheet is performed by discharging ink from the printhead 7 based on printing data.

According to this embodiment, the speeds of the conveyance roller 5, reversing roller 21, and intermediate roller 3 at the time of the reversing operation are controlled based on the reversing operation speed corresponding to the ink discharge amount on the first surface 1-A. This allows printing on the second surface by conveying the reversed printing sheet to the printing region without causing a conveyance failure even if the printing sheet readily deflects due to printing on the first surface.

Third Embodiment

In this embodiment, an arrangement for calculating an ink discharge amount by dividing the first surface of a printing sheet into a plurality of partial regions and setting a weighting coefficient in each partial region will be described. The arrangement of a printing apparatus according to this embodiment is the same as that in the first embodiment. The arrangement of the partial regions is the same as that shown in PT1 of FIG. 10A or PT2 of FIG. 10B described in the second embodiment.

Figure 13A:
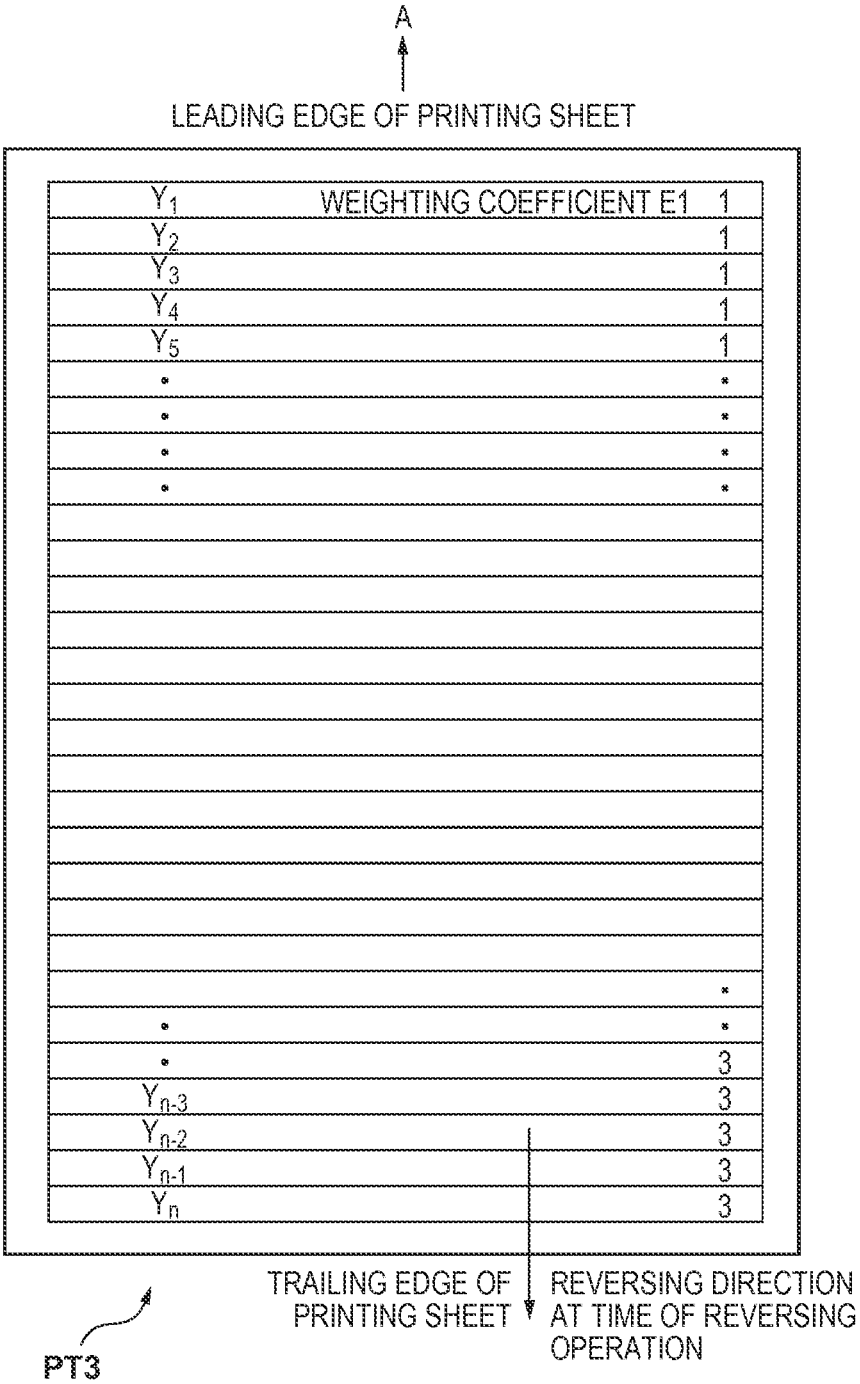

In FIG. 13A, PT3 shows a case in which a weighting coefficient E1 is set in each area in PT1 of FIG. 10A, and PT4 of FIG. 13B shows a case in which a weighting coefficient E2 is set in each subarea in PT2 of FIG. 10B. Referring to FIGS. 13A and 13B, an arrow A indicates the conveyance direction of the printing sheet. In this embodiment, a discharge amount calculation unit 2012 can calculate an ink discharge amount based on a reference discharge amount and a value obtained by multiplying a droplet count by the weighting coefficient set for each partial region.

When the weighting coefficient set in each partial region (each area or each subarea) of the printing sheet is applied to the ink discharge amount calculation processing shown in FIG. 11, as shown in FIGS. 13A and 13B, processing in step S16 is as follows. For example, the weighting coefficient of an ink color (black: PBK) is set to 2 and the weighting coefficient of a partial region (area or subarea) is set to 3. A droplet count detected in this partial area (area or subarea) is multiplied by the weighting coefficient (2) of the ink color and that (3) of the partial region (area or subarea) (=droplet count×6). That is, the detected droplet count is multiplied by a weighting coefficient of 6, and this multiplication result is represented by M.

In step S17, the weighting coefficient of an ink color (cyan (C)) is set to 1, and the weighting coefficient of a partial region (area or subarea) is set to 3. A droplet count detected in this partial region (area or subarea) is multiplied by the weighting coefficient (1) of the ink color and that (3) of the partial region (area or subarea) (=droplet count×3). That is, the detected droplet count is multiplied by a weighting coefficient of 3, and this multiplication result is represented by N.

In step S18, based on the reference discharge amount (C1) and the total of the multiplication results M and N each calculated based on the weighting coefficient of the ink color and that of the partial region (area or subarea), an ink discharge amount in each partial region (area or subarea) is calculated. Then, the calculated ink discharge amount is compared with a threshold Ath.

An MPU 201 can accurately determine a portion of the printing sheet, which readily deflects due to printing on the first surface 1-A, by reflecting the weighting coefficient set for each partial region (each area or each subarea) of the printing sheet in calculation of the ink discharge amount. By using the determination result to control the speeds of the respective rollers at the time of the reversing operation, it is possible to print on the second surface by conveying the reversed printing sheet to the printing region without causing a conveyance failure even if the printing sheet readily deflects due to printing on the first surface.

Fourth Embodiment

In this embodiment, an arrangement will be described in which the speeds of respective rollers are controlled, in accordance with the position of a printing sheet conveyed along a conveyance path at the time of a reversing operation, by using a plurality of reversing speed selection tables corresponding to positions (speed switching points) for switching the speeds.

Tables stored in a ROM 202 include a plurality of reversing speed selection tables (TB4*a* and TB4*b*) for storing speed information for controlling the speeds of the respective rollers in correspondence with positions for switching the speeds. Assume that a plurality of detection units (printing sheet detection units) for detecting the printing sheet are arranged at different positions along the conveyance path in correspondence with the positions (speed switching points) for switching the speeds of the respective rollers.

An MPU 201 controls the speeds of a conveyance roller 5, reversing roller 21, and intermediate roller 3 in accordance with the position of the printing sheet conveyed along the conveyance path. That is, based on the detection results of the plurality of detection units (printing sheet detection units), the MPU 201 refers to the reversing speed selection tables (TB4*a* and TB4*b*) corresponding to the detection results. The MPU 201 determines a speed corresponding to an ink discharge amount by referring to the reversing speed selection tables, and switches the speeds of the conveyance roller 5, reversing roller 21, and intermediate roller 3 based on the determined speed.

Referring to FIGS. 14A and 14B, TB4*a* exemplifies a reversing speed selection table corresponding to speed switching points D1, D4, and D5, and TB4*b* exemplifies a reversing speed selection table corresponding to speed switching points D2 and D3. The example of the arrangement of the reversing speed selection table is not limited to this, and it is possible to control the speeds of the conveyance roller 5, reversing roller 21, and intermediate roller 3 using different tables in correspondence with the respective speed switching points.

When this embodiment is applied to the ink discharge amount calculation processing shown in FIG. 11, processes in steps S19, S20, and S23 are as follows. A threshold Ath is individually set for each speed switching point. When the printing sheet is conveyed through each speed switching point, an ink discharge amount (Duty1, . . . , Duty(Yn)) is compared with the individually set threshold Ath (step S19 of FIG. 11).

If the calculated ink discharge amount (Duty1, . . . , Duty(Yn)) exceeds the individually set threshold Ath (YES in step S19 of FIG. 11), 1 is set in a threshold determination flag f(n) corresponding to each area in step S20 (step S20 of FIG. 11).

In step S23, based on the detection results of the plurality of detection units (printing sheet detection units), the reversing speed selection tables (TB4*a* and TB4*b*) corresponding to the detection results are referred to. With reference to the reversing speed selection tables (TB4*a* and TB4*b*), a speed corresponding to the ink discharge amount is determined. By using the number of set threshold determination flag in which "1" has been set, and the calculated ink discharge amount (largest value), the speeds of the respective rollers (conveyance roller 5, reversing roller 21, and intermediate roller 3) at the time of the reversing operation corresponding to the ink discharge amount at the time of printing on the first surface are determined.

For example, when the printing sheet is conveyed through the speed switching point D1, the MPU 201 determines the speeds of the respective rollers by referring to the reversing speed selection table (TB4*a*). When the printing sheet is conveyed through the speed switching point D2, the MPU 201 determines the speeds of the respective rollers with reference to the reversing speed selection table (TB4*b*). The MPU 201 controls to switch the speeds of the conveyance roller 5, reversing roller 21, and intermediate roller 3 based on the determined speed.

According to this embodiment, at the time of the reversing operation of the printing sheet, it is possible to control the speeds of the conveyance roller 5, reversing roller 21, and intermediate roller 3 in accordance with the conveyance position of the printing sheet. This allows printing on the second surface by conveying the reversed printing sheet to the printing region without causing a conveyance failure even if the printing sheet readily deflects due to printing on the first surface.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170894, filed Aug. 25, 2014, which is hereby incorporated by reference herein in its entirety.

What is claimed is:

1. A printing apparatus comprising:

a printhead configured to print an image by discharging ink to a first surface of a printing sheet and a second surface of the printing sheet;

a conveyance roller arranged upstream of the printhead in a conveyance direction of a printing sheet when executing a printing operation, wherein the conveyance roller is configured to convey a printing sheet in the conveyance direction by rotating in a first direction and to convey the printing sheet in a direction opposite to the conveyance direction by rotating in a second direction opposite to the first direction;

a reversing path configured to reverse a printing sheet;

a reversing roller arranged in the reversing path, and configured to reverse the printing sheet conveyed by the conveyance roller rotating in the second direction and convey the printing sheet to the conveyance roller; and a control unit configured to control a rotation speed in the second direction of the conveyance roller and a rotation speed of the reversing roller based on an ink discharge amount on the first surface of the printing sheet.

2. The apparatus according to claim 1, wherein the control unit drives the reversing roller so as to decrease a rotation speed of the reversing roller in a case where the ink discharge amount on the first surface of the printing sheet is larger than a threshold, as compared with a rotation speed of the reversing roller in a case where the ink discharge amount is smaller than the threshold.

3. The apparatus according to claim 1, further comprising a detection unit configured to detect an ink droplet count at the time of printing on the first surface; and a calculation unit configured to calculate the ink discharge amount based on the ink droplet count and a predetermined reference discharge amount.

4. The apparatus according to claim 3, further comprising a storage unit configured to store a table for associating the ink discharge amount with the rotation speed of the reversing roller, wherein the control unit determines a speed corresponding to the ink discharge amount by referring to the table, and controls driving of the reversing roller based on the determined speed.

5. The apparatus according to claim 3, wherein the detection unit detects the ink droplet count for each of a plurality of partial regions obtained by dividing the first surface of the printing sheet, and the calculation unit calculates the ink discharge amount in the partial region based on the predetermined reference discharge amount and the ink droplet count detected for each of the plurality of partial regions.

6. The apparatus according to claim 5, wherein the calculation unit calculates the ink discharge amount based on the reference discharge amount and a value obtained by multiplying the ink droplet count by a weighting coefficient set for each of the plurality of partial regions.

7. The apparatus according to claim 3, wherein the calculation unit calculates the ink discharge amount based on the reference discharge amount and a value obtained by multiplying the ink droplet count by a weighting coefficient set for each ink color.

8. The apparatus according to claim 5, further comprising a determination unit configured to compare the ink discharge amount in the partial region calculated by the calculation unit with a preset threshold, and determine whether the ink discharge amount exceeds the threshold; and a setting unit configured to set a flag indicating that the ink discharge amount exceeds the threshold if the ink discharge amount exceeds the threshold.

9. The apparatus according to claim 8, wherein the control unit controls driving of the reversing roller based on the speed determined based on the ink discharge amount and the number of set flags.

10. The apparatus according to claim 1, further comprising a printing sheet detection unit arranged in a conveyance path through which the printing sheet is conveyed by the reversing roller, and configured to detect a position of the printing sheet in the conveyance path, wherein the control unit controls the rotation speed of the reversing roller based on the ink discharge amount and a detection result of the printing sheet detection unit.

11. The apparatus according to claim 10, wherein the control unit determines a speed corresponding to the ink discharge amount in accordance with a plurality of different positions detected by the printing sheet detection unit, and switches the rotation speed of the reversing roller based on the determined speed.

12. A control method for a printing apparatus including a printhead configured to print an image by discharging ink to a first surface of a printing sheet and a second surface of the printing sheet, a conveyance roller arranged upstream of the printhead in a conveyance direction of a printing sheet when executing a printing operation, wherein the conveyance roller is configured to convey a printing sheet in the conveyance direction by rotating in a first direction and to convey the printing sheet in a direction opposite to the conveyance direction by rotating in a second direction opposite to the first direction, a reversing path configured to reverse a printing sheet, and a reversing roller arranged in the reversing path, and configured to reverse the printing sheet conveyed by the conveyance roller rotating in the second direction and convey the printing sheet to the conveyance roller, the method comprising:

a control step of controlling a rotation speed in the second direction of the conveyance roller and a rotation speed of the reversing roller based on an ink discharge amount on the first surface of the printing sheet.

13. A non-transitory computer-readable storage medium storing a program for causing a computer to execute a step of a control method for a printing apparatus including a printhead configured to print an image by discharging ink to a first surface of a printing sheet and a second surface of the printing sheet, a conveyance roller arranged upstream of the printhead in a conveyance direction of a printing sheet when executing a printing operation, wherein the conveyance roller is configured to convey a printing sheet in the conveyance direction by rotating in a first direction and to convey the printing sheet in a direction opposite to the conveyance direction by rotating in a second direction opposite to the first direction, a reversing path configured to reverse a printing sheet, and a reversing roller, the method comprising:

a control step of controlling a rotation speed in the second direction of the conveyance roller and a rotation speed of the reversing roller based on an ink discharge amount on the first surface of the printing sheet.

14. The apparatus according to claim 1, wherein the control unit drives the conveyance roller so as to decrease a rotation speed in the second direction of the conveyance roller in a case where the ink discharge amount on the first surface of the printing sheet is larger than a threshold, as compared with a rotation speed in the second direction of the conveyance roller in a case where the ink discharge amount is smaller than the threshold.

15. The apparatus according to claim 1, further comprising a feeding roller arranged upstream of the conveyance roller in the conveyance direction, and configured to feed a printing sheet to the conveyance roller, wherein the reversing roller is configured to convey the printing sheet conveyed by the conveyance roller rotating in the second direction to the conveyance roller via the feeding roller, and the control unit is configured to control the rotation speed of the feeding roller based on the ink discharge amount on the first surface of the printing sheet.

16. The apparatus according to claim 15, wherein the control unit drives the feeding roller so as to decrease a rotation speed of the feeding roller in a case where the ink discharge amount on the first surface of the printing sheet is larger than a threshold, as compared with a rotation speed of the feeding roller in a case where the ink discharge amount is smaller than the threshold.

17. The apparatus according to claim 15, further comprising a first motor configured to drive the conveyance roller; and a second motor configured to drive the feeding roller, wherein the reversing roller is configured to be driven by the second motor, and the control unit is configured to control a driving speed of the first motor and a driving speed of the second motor based on the ink discharge amount on the first surface of the printing sheet.

18. A printing apparatus comprising:

a printhead configured to print an image by discharging ink to a first surface of a printing sheet and a second surface of the printing sheet;

a conveyance roller arranged upstream of the printhead in a conveyance direction of a printing sheet when executing a printing operation, wherein the conveyance roller is configured to convey a printing sheet in the conveyance direction by rotating in a first direction and to convey the printing sheet in a direction opposite to the conveyance direction by rotating in a second direction opposite to the first direction;

a reversing path configured to reverse a printing sheet, wherein the reversing path is configured not to convey printing sheet in a case where the image is printed on the first surface of the printing sheet, and the reversing path is configured to convey the printing sheet in a case where the printing sheet is reversed after printing on the first surface of the printing sheet;

a reversing roller arranged in the reversing path, and configured to reverse the printing sheet conveyed by the conveyance roller rotating in the second direction and convey the printing sheet to the conveyance roller; and a control unit configured to control the reversing roller such that a rotation speed of the reversing roller in a case where the ink discharge amount on the first surface of the printing sheet is larger than a threshold is lower than a rotation speed of the reversing roller in a case where the ink discharge amount is smaller than the threshold.

19. The apparatus according to claim 18, wherein the control unit is configured to control the conveyance roller such that a rotation speed in the second direction of the conveyance roller in a case where the ink discharge amount on the first surface of the printing sheet is larger than the threshold is lower than a rotation speed in the second direction of the conveyance roller in a case where the ink discharge amount is smaller than the threshold.

20. The apparatus according to claim 19, further comprising a feeding roller arranged upstream of the conveyance roller in the conveyance direction, and configured to feed a printing sheet to the conveyance roller, wherein the reversing roller is configured to convey the printing sheet conveyed by the conveyance roller rotating in the second direction to the conveyance roller via the feeding roller, and the control unit is configured to control the feeding roller such that a rotation speed of the feeding roller in a case where the ink discharge amount on the first surface of the printing sheet is larger than the threshold is lower than a rotation speed of the feeding roller in a case where the ink discharge amount is smaller than the threshold.

21. The apparatus according to claim 20, further comprising a first motor configured to drive the conveyance roller; and a second motor configured to drive the feeding roller, wherein the reversing roller is configured to be driven by the second motor, and the control unit is configured to control a driving speed of the first motor and a driving speed of the second motor based on the ink discharge amount on the first surface of the printing sheet.

22. The apparatus according to claim 18, wherein the control unit is configured to control the reversing roller based on the ink discharge amount on a predetermined area of the first surface of the printing sheet.

23. The apparatus according to claim 18, wherein the reversing path has a curved portion.

24. A printing apparatus comprising:

a printhead configured to print an image by discharging ink to a first surface of a printing sheet and a second surface of the printing sheet;

a conveyance roller arranged upstream of the printhead in a conveyance direction of a printing sheet when executing a printing operation, wherein the conveyance roller is configured to convey a printing sheet in the conveyance direction by rotating in a first direction and to convey the printing sheet in a direction opposite to the conveyance direction by rotating in a second direction opposite to the first direction;

a reversing path configured to reverse a printing sheet;

a reversing roller arranged in the reversing path, and configured to reverse the printing sheet conveyed by the conveyance roller rotating in the second direction and convey the printing sheet to the conveyance roller; and a control unit configured to control the conveyance roller and the reversing roller such that a rotation speed in the second direction of the conveyance roller in a first case where the ink discharge amount on the first surface of the printing sheet is larger than a threshold is lower than a rotation speed in the second direction of the conveyance roller in a second case where the ink discharge amount is smaller than the threshold, and a rotation speed of the reversing roller in the first case is lower than a rotation speed of the reversing roller in the second case.

25. The apparatus according to claim 24, further comprising a feeding roller arranged upstream of the conveyance roller in the conveyance direction, and configured to feed a printing sheet to the conveyance roller, wherein the reversing roller is configured to convey the printing sheet conveyed by the conveyance roller rotating in the second direction to the conveyance roller via the feeding roller, and the control unit is configured to control the feeding roller such that a rotation speed of the feeding roller in the first case is lower than a rotation speed of the feeding roller in the second case.

26. The apparatus according to claim 25, further comprising a first motor configured to drive the conveyance roller; and a second motor configured to drive the feeding roller, wherein the reversing roller is configured to be driven by the second motor, and the control unit is configured to control a driving speed of the first motor and a driving speed of the second motor based on the ink discharge amount on the first surface of the printing sheet.

27. The apparatus according to claim 24, wherein the control unit is configured to control the conveyance roller and the reversing roller based on the ink discharge amount on a predetermined area of the first surface of the printing sheet.

28. The apparatus according to claim 24, wherein the reversing path is configured not to convey printing sheet in a case where the image is printed on the first surface of the printing sheet, and the reversing path is configured to convey the printing sheet in a case where the printing sheet is reversed after printing on the first surface of the printing sheet.

29. The apparatus according to claim 24, wherein the reversing path has a curved portion.

* * * * *